US010505283B2

(12) United States Patent
Retter et al.

(10) Patent No.: US 10,505,283 B2
(45) Date of Patent: Dec. 10, 2019

(54) MULTIFOCAL PHASED ARRAY FED REFLECTOR ANTENNA

(71) Applicant: ELTA SYSTEMS LTD., Ashdod (IL)

(72) Inventors: Alon Retter, Shoham (IL); Alex Frenkel, Gan Yavne (IL)

(73) Assignee: ELTA SYSTEMS LTD, Ashdod (IL)

( * ) Notice: Subject to any disclaimer, the term of this patent is extended or adjusted under 35 U.S.C. 154(b) by 171 days.

(21) Appl. No.: 15/405,573

(22) Filed: Jan. 13, 2017

(65) Prior Publication Data

US 2017/0222327 A1 Aug. 3, 2017

(30) Foreign Application Priority Data

Jan. 28, 2016 (IL) ..... 243863

(51) Int. Cl.
*H01Q 19/12* (2006.01)
*H01Q 15/16* (2006.01)
(Continued)

(52) U.S. Cl.
CPC ..... *H01Q 15/16* (2013.01); *H01Q 1/48* (2013.01); *H01Q 3/2658* (2013.01);
(Continued)

(58) Field of Classification Search
None
See application file for complete search history.

(56) References Cited

U.S. PATENT DOCUMENTS 3,775,769 A 11/1973 Heeren et al.
3,828,252 A * 8/1974 Wolff ..... G01D 7/12 324/157
(Continued)

FOREIGN PATENT DOCUMENTS

CN 103022699 A 4/2013
CN 105226398 1/2016
(Continued)

OTHER PUBLICATIONS

Mrstik et al., "Scanning Capabilities of Large Parabolic Cylinder Reflector Antennas with Phased-Array Feeds," IEEE Transactions on Antennas and Propagation, May 1981, pp. 455-462, vol. AP-29, No. 3.

(Continued)

*Primary Examiner* — Trinh V Dinh
(74) *Attorney, Agent, or Firm* — Dorsey & Whitney LLP

(57) ABSTRACT

At least one embodiment of the present invention includes an antenna system comprising a multifocal reflector having at least two reflecting segments having different curvatures defining at least two different spaced apart focal points, such that the multifocal reflector is configured and operable to receive radiation incident on the segments at different incident angles within a certain angular range, and reflect the incident radiation onto the at least two focal points in a focal axis, thereby creating focused radiation formed by at least two differently focused portions of radiation; a phased array feed antenna unit located perpendicularly to the focal axis and comprising a plurality of antenna elements for receiving/transmitting at least two differently focused portions, and a feed network connected to the plurality of the antenna elements for selectively actuating the antenna elements for performing electronic scanning of the space area aimed at detecting target.

11 Claims, 7 Drawing Sheets

(51) Int. Cl.

| | |
|---|---|
| ***H01Q 1/48*** | (2006.01) |
| ***H01Q 21/22*** | (2006.01) |
| ***H01Q 3/26*** | (2006.01) |
| ***H01Q 19/17*** | (2006.01) |
| ***H01Q 25/00*** | (2006.01) |

(52) U.S. Cl.
CPC ..... *H01Q 19/17* (2013.01); *H01Q 21/22* (2013.01); *H01Q 25/007* (2013.01)

(56) References Cited

U.S. PATENT DOCUMENTS

| | | | | |
|---|---|---|---|---|
| 4,156,243 | A | 5/1979 | Yorinks et al. | |
| 4,203,105 | A | 5/1980 | Dragone et al. | |
| 4,618,867 | A * | 10/1986 | Gans | H01Q 19/19 343/781 P |
| 5,309,167 | A | 5/1994 | Cluniat et al. | |
| 6,268,835 | B1 * | 7/2001 | Toland | H01Q 1/08 343/781 P |
| 6,392,611 | B1 | 5/2002 | Smith et al. | |
| 2014/0225798 | A1 * | 8/2014 | Huber | H01Q 3/2658 343/835 |
| 2014/0313074 | A1 | 10/2014 | Chang et al. | |
| 2015/0061930 | A1 | 3/2015 | Runyon | |
| 2015/0138018 | A1 | 5/2015 | Yamamoto et al. | |
| 2015/0241012 | A1 * | 8/2015 | Wang | F21S 41/147 362/517 |

FOREIGN PATENT DOCUMENTS

| | | | |
|---|---|---|---|
| JP | 2011124855 | A | 6/2011 |
| WO | 2009102370 | A1 | 8/2009 |

OTHER PUBLICATIONS

Kira, F., et al. 2002. "Modified multi-focal paraboloid design for high aperture efficiency multibeam reflector antenna", 2002 Digest, IEEE Antennas and Propagation Society International Symposium, 1: 662-665. XP010591999.

* cited by examiner

MULTIFOCAL PHASED ARRAY FED REFLECTOR ANTENNA

TECHNOLOGICAL FIELD

Embodiments of the present invention is in the field of antennas and, more particularly, to electronically scanning antenna.

BACKGROUND

Reflector antennas are widely used in the millimeter-wave region. They are typically single-beam antennas of moderate or high directivity gain for communication, radar and sensing, and monopulse antennas for tracking and guidance due to their large surface. Most of the beam scanning antennas, based on the principles of the reflector antennas, in commercial use today are mechanically controlled and are thereby capable of mechanical scan. This has a number of disadvantages including: limited beam scanning speed as well as limited lifetime, reliability and maintainability of the mechanical components such as motors and gears.

Microwave terrestrial and satellite communications systems are rapidly being greater than deployed to serve communications needs. In these systems, to ensure a radio communication link between a fixed station on the ground or on a satellite and a mobile station such as an automobile or airplane, antenna systems with scanning beams have been put into practical use. A scanning beam antenna is one that can change its receiving/transmission direction, usually for the purpose of maintaining a radio link, e.g. to a tower or satellite, as a mobile terminal is moving and changing direction. Another application of a scanning beam antenna is in a point-to-multipoint terrestrial link where the beams of a hub antenna or remote antenna must be pointed at different locations on a dynamic basis.

Electronically scanned antennas are becoming more important with the need for higher speed data, voice and video communications through geosynchronous earth orbit (GEO), medium earth orbit (MEO) and low earth orbit (LEO) satellite communication systems and point-to-point and point-to-multipoint microwave terrestrial communication systems. Additionally, new applications such as automobile radar for collision avoidance can make use of antennas with electronically controlled beam directions.

Phased array antennas are well known to provide such electronically scanned beams and could be an attractive alternative to mechanically tracking antennas because they have the features of high beam scanning (tracking) speed and low physical profile. Furthermore, phased array antennas can provide multiple beams so that multiple signals of interest can be tracked simultaneously, with no antenna movement. Phased array antennas are capable of steering transmission and reception beams over a field of view. A phased array may be used to point a fixed radiation pattern, or to scan rapidly in azimuth and/or elevation. Beam scanning in a volume array is accomplished by connecting a phase shifter to every element and compensating for phase differences between the elements for a desired scan direction. The directivity of a phased array antenna is largely determined by the number of antenna elements in the phased array. Therefore, generally the phased array antennas are composed of hundreds or even thousands elements increasing the complexity and the cost of such antennas.

Adding a reflector, such as a parabolic reflector, to the phased array antenna can increase the directivity of the antenna without increasing the number of phased array elements. Most reflector antennas are focused systems that use a single feed aligned to the focal point of the reflector or reflector system. The focused system uses a focused antenna where the reflector(s) serves to focus the energy incident on the main reflector at a single point. When an array feed is used with a focused reflector system, feed array elements that are not on the focal point produce beams that have significant phase error, since they are not focused, resulting in distorted beam shapes and reduced beam gain. Moreover, the electronic scanning capability of the phased array fed reflector antenna is limited to about ±10 beamwidth scan for a given frequency (for example for high gain antenna until about 2° angle) (see for example Mrstik A. V., & Smith, P. G., "Scanning Capabilities of Large Parabolic Cylinder Reflector Antennas with Phased-Array Feeds" IEEE Trans. Antennas Propagat., vol. AP-29, May 1981).

Another technique is to use a very long focal length reflector to reduce the defocusing effects with scan. In this technique, the feed element displacement from the focal point required to scan the beam is proportional to the focal length.

In addition to having a large aperture, many antennas preferably have agile scan capability, which is the ability to rapidly (i.e., electronically, instead of mechanically) scan a region over a wide angular range. In a phased array antenna, a set of amplitude and phase control electronics drive each radiating element. The control electronics are typically quite flexible and allow a phased array antenna to achieve an enormous angular range. For example, a phased array antenna may have an angular range up to about ±70 degrees. Unfortunately, as the aperture size of a phased array antenna increases, the amount of radiating elements and associated control electronics drastically increases, with a concomitant increase in power consumption, thermal dissipation and weight. The complexity of the structural design and the deployment also increase drastically. In other words, large aperture phased array antennas are impractical from economic and engineering standpoints. The presently used phased array antennas are too expensive for most commercial applications. Their use has been generally limited to relatively small quantities of specialized and expensive systems such as military, aircraft, and space systems. Typically, phased arrays employ hundreds or thousands of radiating elements and a correspondingly high number of phase shift elements. Their cost is proportional to the number of elements and the number of active electronic devices such as amplifiers and phase shifters.

GENERAL DESCRIPTION

There is a need in the art for competitive satellite and/or terrestrial systems, whether for satellite communications, commercial radar applications (such as for cars), or for terrestrial communications applications to provide a phased array antenna that has the features of electronic beam scanning yet is relatively inexpensive.

As indicated above, the known phase array based antennas and reflector-based antennas are practically incapable to provide electronic scan of a desirably wide scan angle. Indeed, scanning capability of the parabolic reflector with phased array antenna, such as described in U.S. Pat. No. 5,309,167. Moreover, the electronic scanning capability of the phased array fed reflector antenna is limited to about ±10 beamwidth scan for a given frequency (for example for high gain antenna until about a 2° angle). With the very long focal length reflector, the problem is that for a given beam displacement range the feeds have to increase in size and number of elements as the focal length grows. Another fundamental aspect of such a focused system is that the beams are scanned primarily by using different feed elements so that any particular beam may only use a small fraction of the feed. Consequently, such a focused system has a low feed utilization.

Therefore, according to a broad aspect of the present invention, there is provided an antenna system comprising a multifocal reflector having at least two reflecting segments having different curvatures defining at least two different spaced apart focal points, such that the multifocal reflector is configured and operable to receive radiation incident on the segments at different incident angles within a certain angular range, and reflect the incident radiation onto the at least two focal points in a focal axis, thereby creating focused radiation formed by at least two differently focused portions of radiation; a phased array feed antenna unit located perpendicularly to the focal axis and comprising a plurality of antenna elements for receiving/transmitting at least two differently focused portions, and a feed network connected to the plurality of the antenna elements for selectively actuating the antenna elements for performing electronic scanning of the space area aimed at detecting target. In this connection, it should be understood that the electronic scanning is performed on the space area surrounding the antenna space, and should be interpreted as transmission and receiving of signals in different directions. The antenna transmits a signal in a specific direction and then receives a return signal. For example an aerial scanning searches for aerial targets in the sky. Therefore, it should be noted that hereinafter, although not illustrated in the figures, the term "radiation" or "beam" refers to the incident/incoming radiation/beam received by the antenna system as well as the transmitted radiation/beam by the antenna, the antenna system of one or more embodiments of the present invention being operable as a transceiver.

In some embodiments, the multifocal reflector comprises at least four segments of paraboloids defining at least two pairs of symmetric reflecting segments around an optical axis passing through a vertex of the multifocal reflector. The optical axis and the focal axis may coincide. The segments having different curvatures defines at least two different focal points around a focal point of the vertex, such that the multifocal reflector is configured and operable to reflect the incident radiation onto the at least two focal points in a focal axis. The multifocal reflector may thus comprise F different focal points, wherein $F \geq 3$, defining $2(F-1)$ symmetric segments of paraboloids having a shape defined by the quadratic function $y=a_n x^2$, 2n being a number of the different symmetric segments. In some embodiments, n increases progressively and continuously, thereby providing for a smooth multi-focal region in the focal axis. Therefore, in some embodiments, the present invention provides a spatial electronic scanning capability to phased array fed reflector antenna by providing a multifocal reflector configured and operable to progressively and continuously change the focus of the system from the center to outside. This electronic scanning capability enables system flexibility by creating beams as needed. The novel system of one or more embodiments of the present invention enlarges the scan angular range at least up to 100 beamwidths (i.e. at least ±15-20°) with relatively few elements for a full phased array system (of the order of several percentages of that in a conventional phased array fed antenna). The novel system of one or more embodiments of the present invention is useful for radar in satellite and missile tracking, in experimental fields, for target detection and tracking radars or for discrimination radar in a cost effective manner. The parameters of the novel system of one or more embodiments of the present invention is optimally designed according to the customer's requirements such as the reflector's dimensions, the polish intensity of the reflector to multifocal, the number of elements, the higher scan angular range . . . .

In some embodiments, the phased array feed antenna unit is a two-dimensional scan phased array antenna. The phased array feed antenna unit has characteristic controllable parameters including number of antenna elements, reflector's dimensions, phased array feed antenna unit's dimensions, the number of focal points of the multifocal reflector, the angular range of the electronic scanning which may be adjusted according to specific requirements of the need of the antenna system.

In some embodiments, the angular range of the electronic scanning is at least up to about 100 beamwidths.

In some embodiments, the antenna system comprises an additional reflector being aligned with the phased array feed antenna unit about the optical axis of the multifocal reflector and being configured and operable to direct the incident radiation into the multifocal reflector. The additional reflector may be configured as a multifocal reflector having at least two reflecting segments having different curvatures defining at least two different spaced apart focal points, such that the additional multifocal reflector is configured and operable to receive radiation incident on the segments at different incident angles within a certain angular range, and reflect the incident radiation onto the at least two focal points in a secondary focal axis. The multifocal reflector may have a hyperboloid shape.

According to another broad aspect of the present invention, there is provided a method comprises receiving radiation at different incident angles within a certain angular range, reflecting the radiation onto at least two spaced apart focal points in a focal axis, thereby creating focused radiation formed by at least two differently focused portions of radiation; receiving/transmitting one of the at least two differently focused portions, and performing electronic scanning of the space area.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
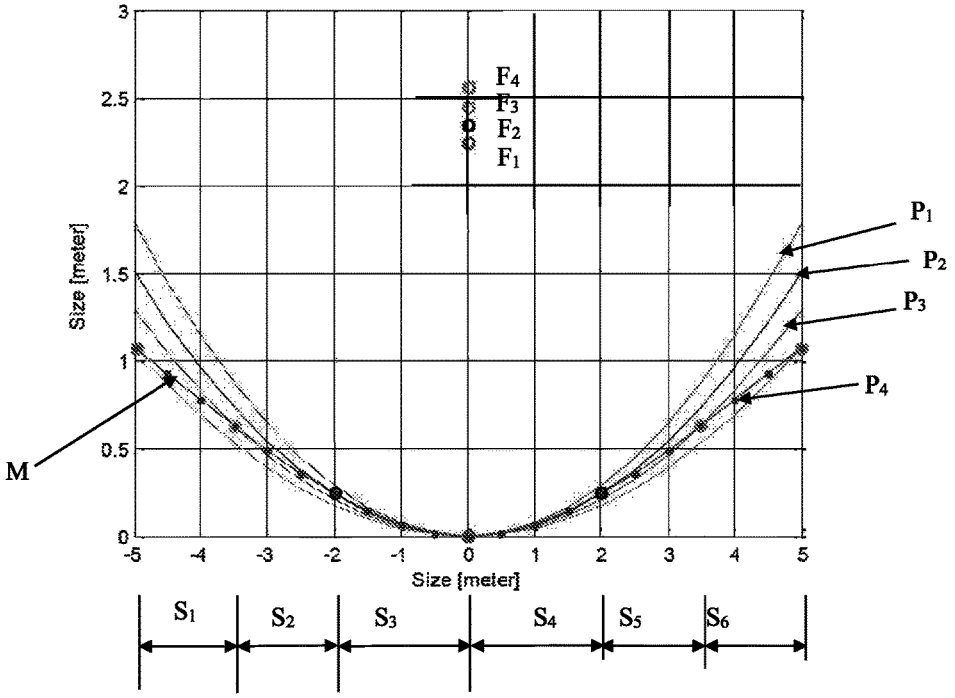
FIG. 1 illustrates a specific and non-limiting example of a possible configuration of the multifocal reflector of an embodiment of the present invention.

Reference is made to FIG. 1 representing an example of the multifocal reflector of the present invention. In this example, the multifocal reflector M has six segments of paraboloids $S_1$-$S_6$ having a different curvature and being symmetric around an optical axis O passing through the vertex of the parabola. As illustrated, the different six reflecting segments define four different spaced apart focal points $F_1$-$F_4$. The intersection is shown for four different parabolas ($P_1$-$P_4$) being a graph of the quadratic function $y=a_n x^2$ when $1 \leq n \leq 4$ defines different focus with an increasing value. More generally, the multifocal reflector of the present invention can comprise F different focal points, wherein $F \geq 3$, defining 2(F−1) symmetric segments of paraboloids and having a shape defined by the quadratic function$=a_n x^2$, 2n being a number of the different symmetric segments. Thus, the multifocal reflector of the present invention having F focal points reflects an incoming radiation beam similarly to F conventional reflectors, each having a different curvature and therefore a different focus. Therefore, the multifocal reflector reflects the incident/incoming radiation onto the spaced apart focal points, thereby creating focused radiation formed by at least two differently focused portions of radiation.

In some embodiments the multifocal reflector has a shape defined by the quadratic function $y=a_n x^2$, wherein n increases progressively and continuously, thereby providing for a smooth multi-focal region. It should be noted that although a parabolic reflector is represented in the figures, the multifocal reflector of one or more embodiments of the present invention is not limited to a parabolic shape. The multifocal correction can be added to any reflector having any curved shape being convex or concave. For example, a multifocal correction can also be applied to cylindrical, ellipsoidal, or hyperboloidal reflectors. To provide a multifocal correction to such reflectors, at least two segments of the reflecting surface of the reflector are deformed/distorted to obtain at least two segments having different curvatures and defining at least two different focal points, such that the multifocal reflector is configured and operable to receive radiation incident on the at least two segments at different incident angles within a certain angular range, and reflecting the incident radiation onto the at least two spaced apart focal points, thereby creating focused radiation formed by at least two differently focused portions of radiation. The phased array feed antenna unit is then located perpendicularly to the focal axis for receiving the focused radiation as will be described further below.

Figure 2A:
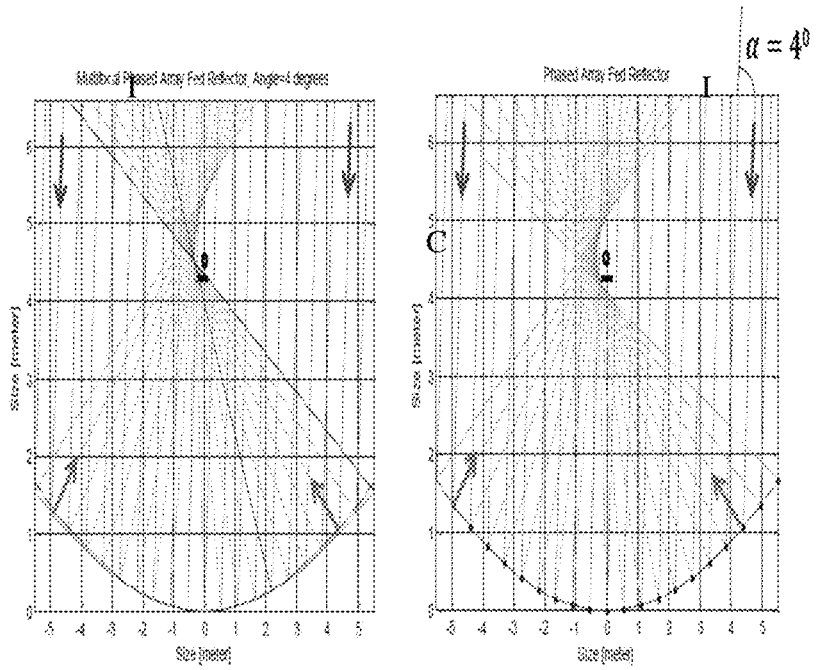
FIGS. 2A-2B illustrates the antenna system of an embodiment of the present invention (FIG. 2B), and a conventional phased array fed reflector system for the sake of comparison (FIG. 2A)
Figure 2B:
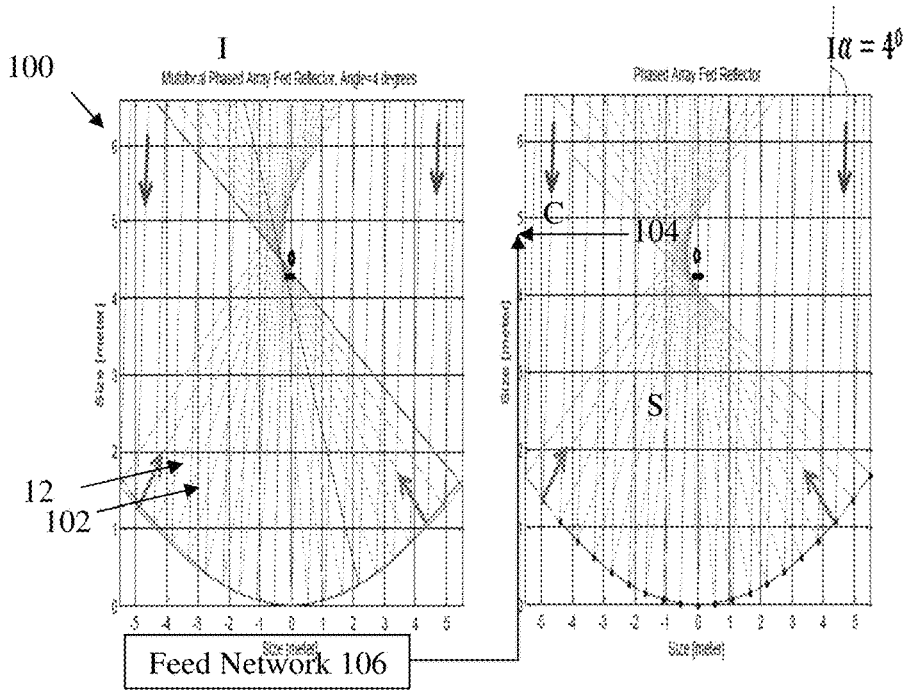

Reference is made now to FIGS. 2A-2B illustrating the antenna system of one or more embodiments of the present invention (FIG. 2B) and a conventional phased array fed reflector system for the sake of comparison (FIG. 2A). Generally, the phased array fed reflector systems are configured such that the feed antenna array is aligned with the single focal point of the parabolic reflector. However, as illustrated in the figure, for a conventional reflector having a length of 11 m and a focal length of 4.5 m and $d=0.75\lambda$ where d is the distance between adjacent elements and $\lambda$ the wavelength of the radiation, when the radiation has an incident direction of a certain angular range with respect to the optical axis of the parabolic reflector, 4° in this specific example, the radiation reflected from the reflector does not reach the feed antenna array. The optical coverage is thus zero.

To overcome this problem, one or more embodiments of the present invention provide a reflector having a multiple different focal points enabling the focusing of the reflected beam onto the phased array feed antenna unit. The antenna system 100 comprises a multifocal reflector 102 having different focal points and a phased array feed antenna unit 104 located in the plane perpendicular to the focal/optical axis comprising a plurality of antenna elements for receiving the focused radiation. The multifocal reflector 102 is configured and operable to receive an incident radiation I on the different segments at different incident angles within a certain angular range (4° in this specific example) and focusing the radiation I depending upon the direction from which the radiation is received and reflecting the incident radiation onto the spaced-apart focal points. In this specific and non-limiting example, the phased array feed antenna unit 104 is located in a plane perpendicular to the focal axis before one focal point and receives the focused radiation S. However, the phased array feed antenna unit 104 may also be located after one focal point. Indeed, the phase of each element of the phased array feed antenna unit can be adjusted to receive a maximal portion of focused radiation onto a maximal number of elements. Generally, the phased array feed antenna unit 104 is distanced from at least one focal point at an order of a few centimeters. Thanks to the novel antenna system of one or more embodiments of the present invention, the optical coverage of this system is in this specific case about 3.5 m for a multifocal reflector having a length of 11 m. In this specific and non-limiting example, the radiation has a frequency of 10 GHz (X band) enabling the use of the system of the present invention in radio astronomy, microwave devices/communications, wireless LAN, most modern radars, communications satellites, satellite television broadcasting, DBS, amateur radio etc. Therefore, the novel configuration of the novel antenna system of one or more embodiments of the present invention enables to electronically scan the space area by using at least a part of the multifocal reflector. A conventional reflector 12 is also illustrated in the figure for the sake of comparison. For the simplicity of the schematic representation, the illustrated phased array unit 104 is a one dimensional planar scan phased array antenna. However, the invention is not limited to a one-dimensional phase array antenna unit. The examples illustrated in the figures below relate to two-dimensional scan phased array antennas. The antenna elements may be arranged in any possible conventional manner such as quadratic, rectangular, triangular, arbitrary . . . . The phased array feed antenna unit 104 also comprises a feed network 106 connected to the plurality of antenna elements for selectively actuating the antenna elements and performing electronic scanning. The distance between adjacent elements d can be adjusted for an optimal scan angular range. In this connection, it should be understood that, in some embodiments, the focus changes progressively and continuously, thereby providing for a smooth multi-focal region.

Figure 3:
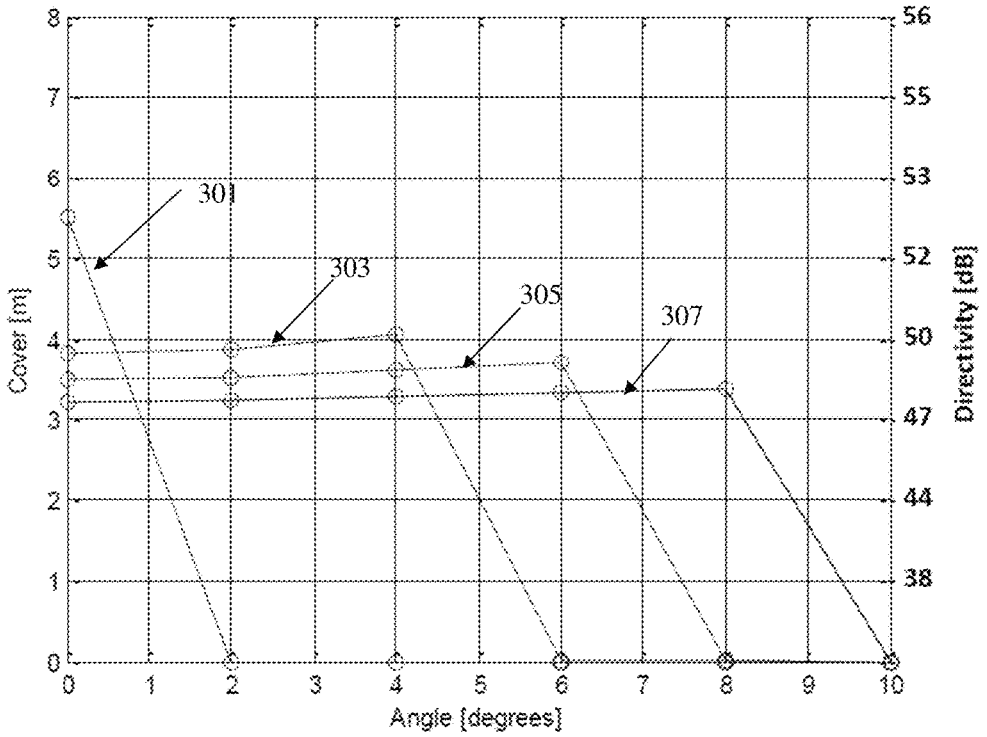
FIG. 3 illustrates optimal results calculated by using the novel antenna system of an embodiment of the present invention having a multifocal reflector with a length of 5.5 m, a phased array unit having 20×20 elements.

Reference is made to FIG. 3 illustrating the optimal results calculated by using the novel antenna system of one or more embodiments of the present invention having a multifocal reflector with a length of 5.5 m, a phased array unit having 20×20 elements and d=0.75λ. It should be noted that for the simplicity of the optimization, the simulations assumes that the antenna elements can radiate up to ±90°. In this specific and non-limiting example, the radiation has a frequency of 10 GHz (X band). Three different configurations plotted as 303,305,307 are compared. An optimization is performed for scans having different angular ranges, to calculate the angle coverage of the reflector in meters for each different scan angle. Then, the directivity is calculated by translating the angle coverage of the reflector for a specific frequency into dB. For the sake of comparison, a regular reflector is illustrated in curve 301 having a directivity of about 52.5 dB up for a beam being scanned up to 2° covering an area of 5.5 m. For a scan angular range up to 4°, as illustrated in curve 303, the multifocal reflector has a directivity of about 50 dB and a coverage area of about 4 m. For a scan angular range up to 6°, as illustrated in curve 305, the directivity is about 49 dB and the coverage area about 3.5 m. For a scan angular range up to 8°, as illustrated in curve 307, the directivity is about 48 dB and the coverage area about 3.2 m. Therefore, there is a tradeoff between the scan angular range that can be achieved by using the system and the directivity/cover area of the system. It can also be seen from the optimum results that by using the novel system of one or more embodiments of the present invention, the loss of the coverage area is relatively low, a maximum of about 1.5 m for a scan angular range up to 4°.

Figure 4:
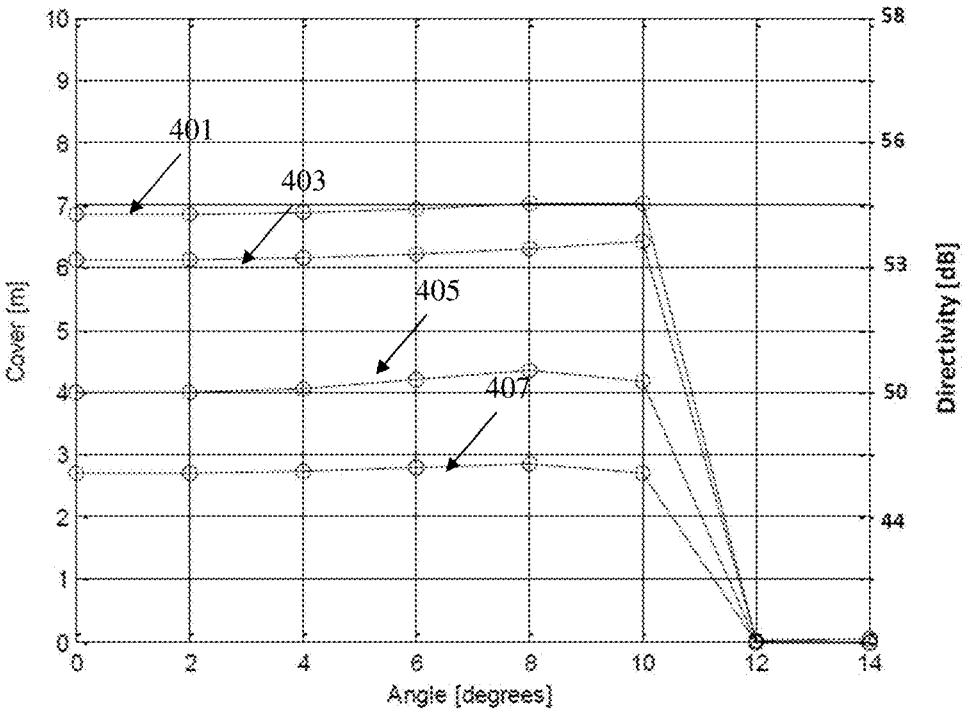
FIG. 4 illustrates the directivity and the coverage area calculated by using the novel antenna system of an embodiment of the present invention having a multifocal reflector with a length of 10 m and a phased array antenna unit having a varying number of elements.

Reference is made to FIG. 4 illustrating the directivity and the coverage area calculated by using the novel antenna system of one or more embodiments of the present invention having a multifocal reflector with a length of 10 m and a phased array antenna unit having a varying number of elements. In this specific and non-limiting example, the radiation has a frequency of 10 GHz (X band). Four different configurations plotted as 401,403,405,407 are compared when the directivity and the angle coverage are calculated for radiations optimized for a scan angular range of up to ±10°. In some embodiments, the phased array feed antenna unit has characteristic controllable parameters including number of antenna elements, reflector's dimensions, phased array feed antenna unit's dimensions, the number of focal points of the multifocal reflector, the angular range of the electronic scanning that can be controlled to obtain optimal results according to specific needs. In this following specific and non-limiting example, the number of antenna elements is varied. It can be seen from the calculated results illustrated in FIG. 4 that, for an array having 80×80 elements as illustrated in curve 401, the directivity is about 54.5 dB and the coverage area is about 7 m. For an array having 50×50 elements, as illustrated in curve 403, the directivity is about 54 dB and the coverage area is about 6.5 m. For an array having 30×30 elements, as illustrated in curve 405, the directivity is about 51 dB and the coverage area is about 4 m. For an array having 20×20 elements, as illustrated in curve 407, the directivity is about 46.5 dB and the coverage area is about 2.8 m. In this connection, it should be noted that the radiation received by the phased array antenna unit is not entirely focused. Indeed, there is no need to precisely focus all the beams of the incident radiation to the phased array antenna unit, but to ensure that a maximum number of beams of the incident radiation reach a maximum number of antenna elements. To obtain an efficient antenna system, a maximum incident radiation should be collected by the phased array antenna unit. This process is reversible symmetric, and therefore if the collection of the incident radiation is maximal, the transmission and the scan of the radiation would be performed at larger scan angles. Moreover, if all the antenna elements of the phased array antenna unit scan the space area in a specific direction, an optimal scan is obtained. In other words, an efficient antenna system should use a maximal receiving/transmission capacity and therefore as much as possible antenna elements should be used for receiving/transmitting the incident radiation. However, only a portion of the reflector is used for reflecting a radiation along a given scan angular range. As described above, a maximal portion of the reflector should be preferably used. As much as the scan angle is large, as much as a smaller portion of the reflector can be used. For an antenna array unit, the larger the length of a support on which the antenna elements of the array are arranged, higher the gain that can be obtained, i.e. the better the directivity of the radiation pattern (i.e. the gain less the antenna's loss). In other words, as much as a larger portion of the reflector is used, the effective size of the antenna system is larger and the gain is also larger. Moreover, as much as the number of elements increases, a larger portion of the reflector is used increasing the total gain. On the other hand, the distance between the adjacent antenna elements in the phased array is dictated by the operating frequency of the antenna array and the practical upper limit for such distance is of the order of λ/2. Thus, when designing the antenna unit various factors should be considered, such as a physical size (length) of the antenna unit, distance between the antenna elements in the array for a given physical size (length) of the antenna array. Also, the larger the number of antenna elements operating in different directions, the larger the angular coverage of the antenna unit and the larger the directivity of the radiation pattern. It can be seen for these results that with a relatively small number of elements making the system cost effective, the novel system of one or more embodiments of the present invention provides a high directionality and beam coverage. The use of a large portion of the reflector increases the total size of the antenna as well as the gain of the system. The gain directly depends on the effective size of the reflector and only indirectly on the size of the phase array antenna unit which depends on the number of antenna elements. Increasing the number of antenna elements in the phased array unit does not necessarily increase the gain. The number of antenna elements could be increased, but the gain would not necessarily increase and the angular coverage would be still zero. Generally, if there is an angular coverage, as well as the number of elements of the phased antenna array unit increases, the size of the phased antenna array unit increases and then the angular coverage would also increase.

Figure 5:
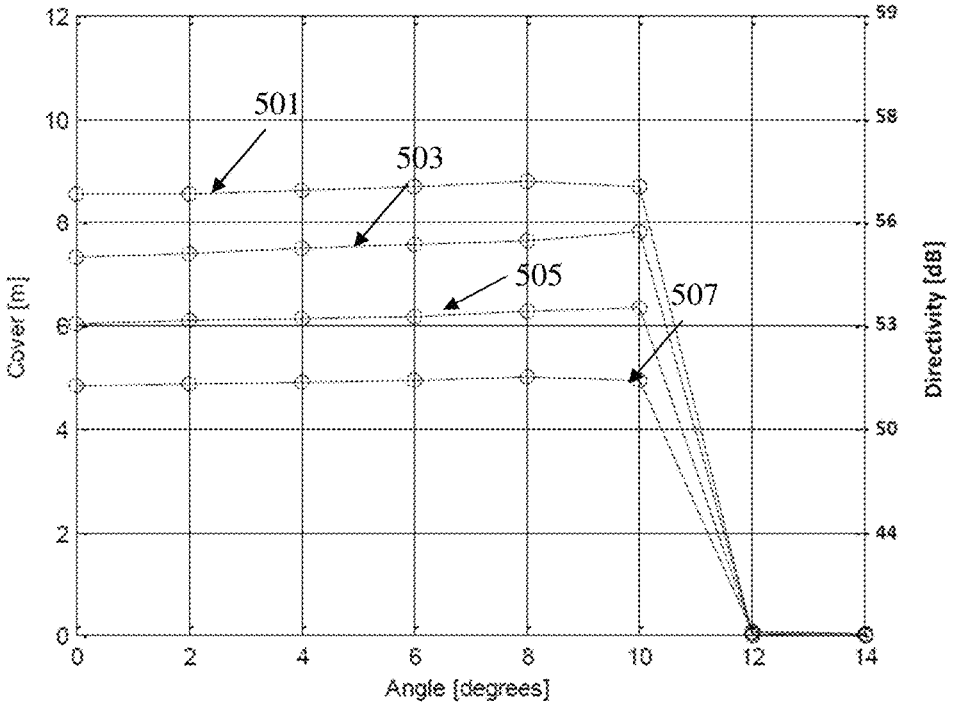
FIG. 5 illustrates the directivity and the coverage area calculated by using the novel antenna system of an embodiment of the present invention having a multifocal reflector with a variable length and a phased array antenna unit having 60×60 elements.

Reference is made to FIG. 5 illustrating the directivity and the coverage area calculated by using the novel antenna system of one or more embodiments of the present invention having a multifocal reflector with a variable length and a phased array antenna unit having 60×60 elements. In this following specific and non-limiting example, the length of the multifocal reflector is varied. In this specific and non-limiting example, the radiation has a frequency of 10 GHz (X band). Four different configurations plotted as 501,503, 505,507 are compared when the directivity and the angle coverage are optimized for a scan angle in the angular range of up to ±10°. It can be seen from the calculated results illustrated in FIG. 5 that, for an array having a length of 15 m, as illustrated in curve 501, the directivity is about 56.5 dB and the coverage area is about 8.5 m. For an array having a length of 12 m, as illustrated in curve 503, the directivity is about 55.5 dB and the coverage area is about 7.8 m. For an array having a length of 9 m, as illustrated in curve 505, the directivity is about 53 dB and the coverage area is about 6 m. For an array having a length of 7 m, as illustrated in curve 507, the directivity is about 51.5 dB and the coverage area is about 5 m. As described above, it can be seen that, generally the larger the size of the reflector is the better the coverage area.

Figure 6:
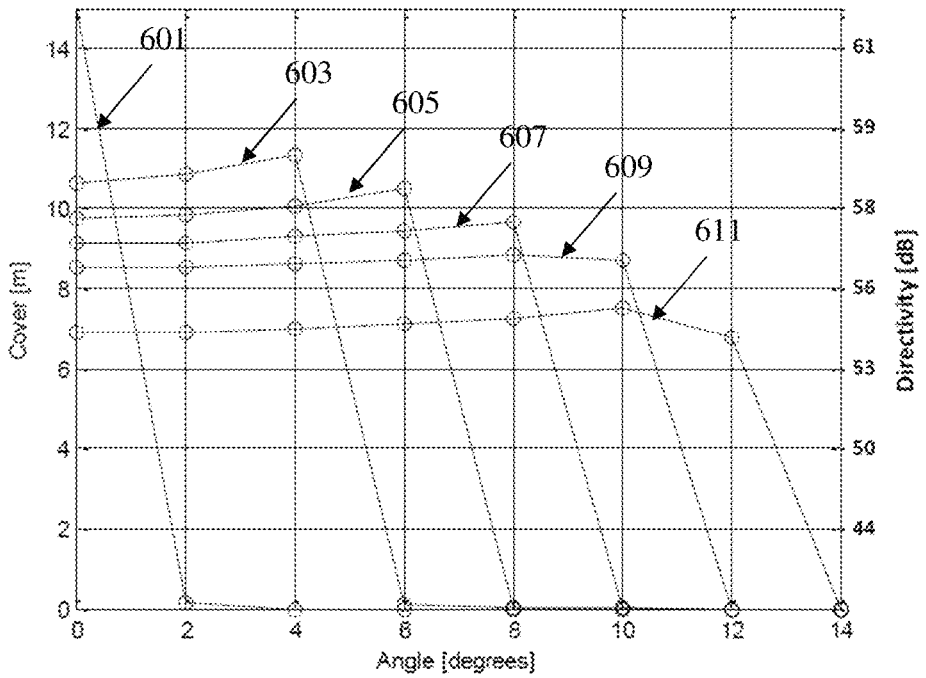
FIG. 6 illustrates optimal results calculated by using the novel antenna system of an embodiment of the present invention having a multifocal reflector with a length of 15 m, a phased array unit having 60×60 elements.

Reference is made to FIG. 6 illustrating the optimal results calculated by using the novel antenna system of one or more embodiments of the present invention having a multifocal reflector with a length of 15 m, a phased array unit having 60×60 elements. Six different configurations are compared when the directivity and the angle coverage are optimized for six different scan angles. In this specific and non-limiting example, the radiation has a frequency of 10 GHz (X band). A conventional phased array fed reflector having a length of 15 m and a phased array unit having 60×60 elements is illustrated in curve 601 for the sake of comparison. It can be seen from the calculated results illustrated in FIG. 6 that, the conventional phased array fed reflector has a maximal coverage area for a zero scan angle but the scan capability of the conventional reflector is limited and is less than a scan angular range of 2°. The multifocal reflector of one or more embodiments of the present invention has a directivity of about 58.5 dB up, as illustrated in curve 603, for a radiation being scanned up to 4° covering an area of about 11 m. For a scan angular range up to 6°, the directivity is about 58 dB as illustrated in curve 605 and the coverage area about 10 m. For a scan angular range up to 8°, the directivity is about 57.7 dB as illustrated in curve 607 and the coverage area about 9.8 m. For a scan angular range up to 10°, the directivity is about 56.5 dB as illustrated in curve 609 and the coverage area about 9 m. For a scan angular range up to 12°, the directivity is about 55 dB as illustrated in curve 611 and the coverage area about 7 m. Therefore, the novel system of one or more embodiments of the present invention provides a high coverage area/directionality and significantly enlarges the scan angular range to at least up to 12°.

Figure 7:
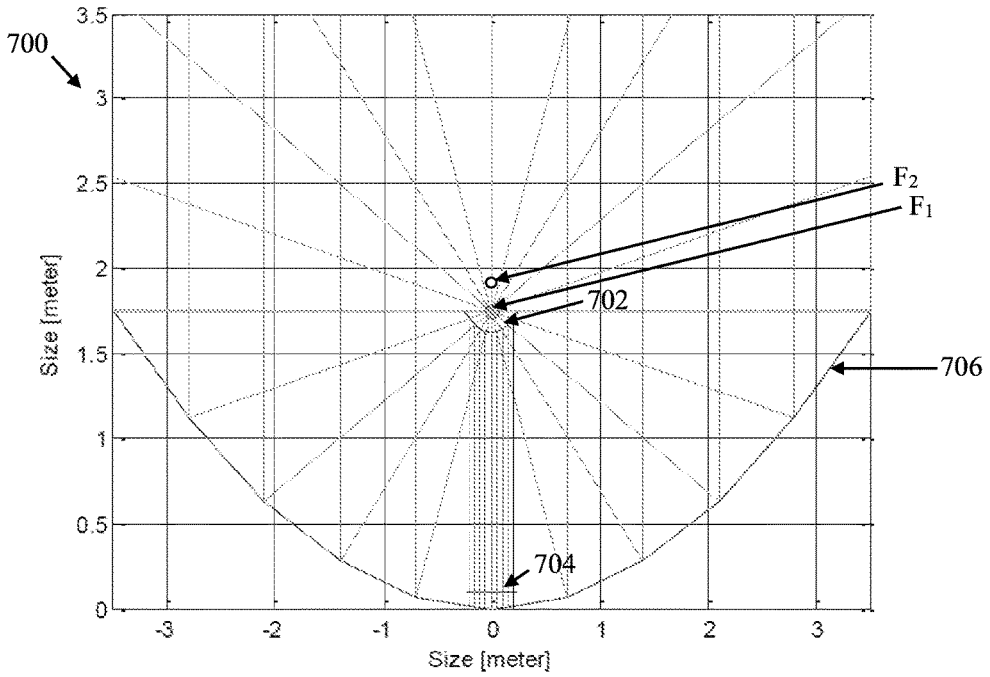
FIG. 7 represents a possible configuration of the antenna system according to some embodiments of the present invention.

Reference is made to FIG. 7 representing a possible configuration of the antenna system of the present invention according to some embodiments. In this specific and non-limiting example, the radiation has a frequency of 10 GHz (X band). In some embodiments, the system antenna comprises an additional reflector used to direct the transmitted radiation into the multifocal reflector. The reflected radiation from the additional primary reflector illuminates the secondary multifocal reflector being smaller than the additional primary reflector, which reflects it back to the phased array antenna unit. For example, the shape of the secondary multifocal reflector may be hyperbolic. The geometrical condition for radiating a collimated, plane wave radiation is that the phased array antenna unit is located at the far focus of the hyperboloid. In the specific and non-limiting example, a Cassegrain configuration is represented, however, other configurations such that Gregorian antennas having a hyperbolic multifocal reflector are also possible. In some embodiments, the primary additional reflector may be a regular reflector or may also have a multifocal configuration according to the principles of the present invention. The primary reflector may then have at least two reflecting segments having different curvatures defining at least two different spaced apart focal points $F_1$ and $F_2$, such that the primary reflector is configured and operable to receive radiation incident on the segments at different incident angles within a certain angular range, and reflect the incident radiation onto at least two focal points $F_1$ and $F_2$ in a secondary focal axis located near the secondary multifocal reflector. In this specific and non-limiting illustrated example, the system 700 comprises a parabolic primary reflector 706, a secondary multifocal reflector 702 having an hyperboloid shape defining a plurality of segments having different focal points $F_1$ and $F_2$ creating a continuous variation of the curvature of the reflector and being placed in front of the primary reflector 706 and a phased array feed antenna unit 704. The primary reflector 706, the secondary multifocal reflector 702 and the phased array feed antenna unit 704 are aligned about the optical axis (i.e. the central axis of the primary reflector 706) and the focus of the primary reflector 706 coincides with the near focus of the secondary multifocal reflector 702 and the phased array feed antenna unit 704 is located near the primary reflector 706. The primary reflector 706 receives an incident radiation, focuses the radiation and reflects a focused transmit signal towards the secondary multifocal reflector 702 which transmits the focused radiation towards the phased array feed antenna unit 704.

The invention claimed is:

1. An antenna system, comprising:

at least four reflecting segments distributed symmetrically at least partially around and transverse to an optical axis that collectively form a multifocal reflector that is shaped as a paraboloid, wherein each of the at least four reflecting segments of the multifocal reflector is shaped as a paraboloid and has a different curvature defining at least three different focal points spaced apart on the optical axis passing through a vertex of the multifocal reflector, such that said multifocal reflector is configured and operable to receive radiation incident on said at least four reflecting segments at different incident angles within a certain angular range, and transmit the incident radiation onto said at least two focal points at a focal axis coinciding with the optical axis, thereby creating focused radiation formed by at least two differently focused portions of radiation;

a phased array feed antenna unit located perpendicularly to said focal axis and comprising a plurality of antenna elements for receiving/transmitting said at least two differently focused radiation; and a feed network connected to said plurality of the antenna elements for selectively actuating the antenna elements for performing electronic scanning.

2. The antenna system of claim 1, wherein the at least four reflecting segments define at least two pairs of symmetric reflecting segments around the optical axis, such that said multifocal reflector is configured and operable to reflect the incident radiation onto said at least four different focal points in the focal axis.

3. The antenna system of claim 2, wherein said multifocal reflector comprises F different focal points, defining 2(F−1) symmetric segments of paraboloids having a shape defined by the quadratic function $y=a_n x^2$, 2n being a number of the different symmetric segments.

4. The antenna system of claim 3, wherein n increases progressively and continuously, thereby providing for a smooth multi-focal region.

5. The antenna system of claim 1, wherein said phased array feed antenna unit is a two-dimensional scan phased array antenna.

6. The antenna system of claim 1, wherein said phased array feed antenna unit has characteristic controllable parameters including one or more of number of antenna elements, reflector's dimensions, phased array feed antenna unit's dimensions, the number of focal points of the multifocal reflector, or the angular range of the electronic scanning.

7. The antenna system of claim 1, wherein the angular range of said electronic scanning is at least up to about 100 beamwidths.

8. The antenna system of claim 1, further comprising an additional reflector being aligned with said phased array feed antenna unit about the focal axis of said multifocal reflector being configured and operable to direct the incident radiation into the multifocal reflector.

9. The antenna system of claim 8, wherein said additional reflector is configured as a multifocal reflector having at least two reflecting segments having different curvatures defining at least two different spaced apart focal points, such that said additional multifocal reflector is configured and operable to receive radiation incident on said segments at different incident angles within a certain angular range, and reflect the incident radiation onto said at least two focal points in a secondary focal axis.

10. The antenna system of claim 1, wherein said multifocal reflector has a hyperboloid shape.

11. The antenna system of claim 9, wherein the first reflector, the additional reflector, and the phased array feed antenna unit are aligned about the optical axis.

* * * * *